US011235486B2

(12) United States Patent
Bucco

(10) Patent No.: US 11,235,486 B2
(45) **Date of Patent: *Feb. 1, 2022**

(54) RAZOR WITH CUTTING BLADE ROTATABLE ABOUT MULTIPLE AXES

(71) Applicant: Thomas J. Bucco, Setauket, NY (US)

(72) Inventor: Thomas J. Bucco, Setauket, NY (US)

(73) Assignee: Sphere USA, LLC, East Setauket, NY (US)

( * ) Notice: Subject to any disclaimer, the term of this patent is extended or adjusted under 35 U.S.C. 154(b) by 480 days.

This patent is subject to a terminal disclaimer.

(21) Appl. No.: 15/849,118

(22) Filed: Dec. 20, 2017

(65) Prior Publication Data

US 2018/0111281 A1 Apr. 26, 2018

Related U.S. Application Data

(63) Continuation of application No. 14/266,913, filed on May 1, 2014, now Pat. No. 9,889,572, which is a (Continued)

(51) Int. Cl.
*B26B 21/52* (2006.01)

(52) U.S. Cl.
CPC ..... *B26B 21/521* (2013.01); *B26B 21/522* (2013.01)

(58) Field of Classification Search
CPC ..... B26B 21/521; B26B 21/522; B26B 21/14; B26B 21/16; B26B 21/40; B26B 21/4012; (Continued)

(56) References Cited

U.S. PATENT DOCUMENTS 650,337 A 5/1900 Nicholls
831,259 A 9/1906 Bingler
(Continued)

FOREIGN PATENT DOCUMENTS

CA 1045365 A1 1/1979
CN 2330471 Y 7/1999
(Continued)

OTHER PUBLICATIONS

Supplementary European Search Report dated Nov. 22, 2013.

*Primary Examiner* — Jason Daniel Prone
(74) *Attorney, Agent, or Firm* — Ryan, Mason & Lewis, LLP

(57) ABSTRACT

A razor includes a cartridge supporting at least one cutting blade and a handle having an elongate gripping portion and an attachment portion at one end of the handle, the attachment portion supporting a pivot member providing a removable attachment to the cartridge. The pivot member includes an at least partially spheroid portion that is configured to be held between spaced-apart ends of two opposed legs. The razor also includes a stop protruding from a surface of the at least partially spheroid portion of the pivot member and configured to limit rotation of the cartridge when the cartridge is mounted on the attachment portion. The stop is configured to limit rotation of the cartridge by interacting with a relief portion of at least one of the two opposed legs. The two opposed legs have respective holes formed therein, and the pivot member is pivotably held between the holes.

20 Claims, 1 Drawing Sheet

Related U.S. Application Data continuation of application No. 13/030,752, filed on Feb. 18, 2011, now Pat. No. 8,720,072.

(60) Provisional application No. 61/372,662, filed on Aug. 11, 2010.

(58) Field of Classification Search
CPC ..... B26B 21/52; Y10T 403/32565; Y10T 403/32573
USPC .... 30/32, 47–51, 526–536; 403/76, 90, 114, 403/115; D28/46–48
See application file for complete search history.

(56) References Cited

U.S. PATENT DOCUMENTS 1,015,575 A 1/1912 Meyer et al.
1,450,604 A * 4/1923 Mossberg ..... B26B 21/52 30/529
1,452,002 A * 4/1923 Reiter ..... B26B 21/52 30/529
1,455,726 A * 5/1923 Hartman ..... B26B 21/52 30/529
1,455,750 A * 5/1923 Hartman ..... B26B 21/52 30/531
1,455,751 A * 5/1923 Harry ..... B26B 21/52 30/529
1,470,757 A * 10/1923 Lauterbach ..... B26B 21/20 30/68
1,552,234 A * 9/1925 Roebuck ..... B26B 21/52 30/529
1,639,441 A * 8/1927 Spahr ..... B26B 21/52 30/529
1,693,532 A * 11/1928 Benjamin ..... B26B 21/52 30/529
1,827,148 A * 10/1931 Hartman ..... B26B 21/52 30/529
2,019,077 A * 10/1935 Haulton ..... B26B 21/52 30/527
2,023,564 A * 12/1935 Winn ..... B26B 21/52 30/74.1
2,029,532 A * 2/1936 Karcher ..... F21V 21/26 403/114
2,083,172 A 8/1937 Smith
2,119,792 A 6/1938 Parkin
2,165,046 A 7/1939 Greenstein
2,194,815 A 3/1940 Testi
2,211,255 A 8/1940 Claassen
2,397,555 A * 4/1946 Lotthamer ..... B26B 21/16 30/36
2,502,585 A * 4/1950 Oberheim ..... B26B 21/30 30/61
2,510,951 A 6/1950 Bleeker et al.
2,592,488 A * 4/1952 Testi ..... B26B 21/14 30/64
2,694,538 A 11/1954 Consolo et al.
2,748,468 A * 6/1956 Testi ..... B26B 21/18 30/65
2,748,470 A * 6/1956 Borden ..... B26B 21/52 30/531
2,780,866 A * 2/1957 Borden ..... B26B 21/52 30/531
2,844,870 A 7/1958 Roces et al.
3,090,642 A 5/1963 Gottschald et al.
3,604,044 A * 9/1971 Johnson ..... A46B 5/0087 403/90
3,935,639 A * 2/1976 Terry ..... B26B 21/225 30/47
3,950,848 A 4/1976 Goldstein
3,950,849 A 4/1976 Perry
3,964,160 A 6/1976 Gordon
4,083,103 A 4/1978 Estandian
4,152,828 A * 5/1979 Lund ..... B26B 21/225 30/529
4,163,316 A 8/1979 Hagmann et al.
4,275,498 A 6/1981 Ciaffone
4,332,321 A * 6/1982 Wratschko ..... B26B 21/52 30/536
4,339,876 A * 7/1982 Davis ..... B26B 21/222 132/289
4,347,663 A * 9/1982 Ullmo ..... B26B 21/225 30/47
4,403,414 A 9/1983 Kiraly et al.
4,411,065 A * 10/1983 Trotta ..... B26B 21/521 30/47
4,422,237 A * 12/1983 Trotta ..... B26B 21/521 30/526
4,446,619 A 5/1984 Jacobson
4,475,286 A 10/1984 Saito
4,488,357 A 12/1984 Jacobson
4,573,266 A 3/1986 Jacobson
4,702,004 A * 10/1987 Haythornthwaite .... B26B 21/14 30/50
4,779,332 A * 10/1988 Butka ..... B26B 21/36 30/46
4,797,998 A * 1/1989 Motta ..... B26B 21/225 30/530
4,922,609 A * 5/1990 Grange ..... B26B 21/521 30/57
4,926,553 A * 5/1990 Miskin ..... B26B 21/225 30/49
5,007,168 A 4/1991 Messinger et al.
5,013,175 A * 5/1991 Hayden ..... B60S 1/24 403/114
5,029,391 A * 7/1991 Althaus ..... B26B 21/225 30/533
D322,144 S * 12/1991 Schneider ..... D28/46
5,070,814 A 12/1991 Hardin et al.
5,093,991 A 3/1992 Hendrickson
5,167,069 A 12/1992 Quinn
5,168,628 A 12/1992 Mock et al.
5,245,754 A 9/1993 Heintke et al.
5,343,621 A 9/1994 Hildebrand et al.
5,347,717 A * 9/1994 Ts'ai ..... B26B 21/225 30/50
5,409,332 A * 4/1995 Chabot, Jr. ..... B25B 23/0014 403/114
5,473,818 A 12/1995 Otsuka et al.
5,515,246 A * 5/1996 Maglica ..... B62J 6/00 362/191
5,526,568 A * 6/1996 Copelan ..... B26B 21/28 30/531
5,535,518 A 7/1996 Althaus
5,526,508 A 8/1996 Copelan
5,551,115 A 9/1996 Newville
5,560,106 A * 10/1996 Armbruster ..... B26B 21/522 30/526
5,579,581 A 12/1996 Melton
5,606,799 A * 3/1997 Melton ..... B26B 19/063 30/199
5,678,316 A 10/1997 Althaus et al.
D389,955 S * 1/1998 Wonderley ..... D28/48
5,704,127 A 1/1998 Cordio
5,771,591 A 6/1998 Armbruster et al.
5,784,790 A * 7/1998 Carson, III ..... B26B 21/225 30/532
5,787,593 A 8/1998 Althaus
5,860,728 A * 1/1999 Maglica ..... B62J 6/00 362/191
5,953,824 A * 9/1999 Ferraro ..... B26B 21/225 30/527
6,116,924 A 9/2000 Oldroyd
6,217,249 B1 * 4/2001 Merlo ..... F16C 11/0604 403/128
6,223,422 B1 5/2001 Takeuchi et al.
D445,958 S * 7/2001 Dansreau ..... B26B 21/522 D28/48
6,266,888 B1 7/2001 Zowaski
6,301,786 B1 10/2001 Oswald et al.

(56) References Cited

U.S. PATENT DOCUMENTS 6,311,400 B1 11/2001 Hawes et al.
6,336,241 B1 1/2002 Wilson
6,381,857 B1 5/2002 Oldroyd
6,418,622 B2 7/2002 Garenfeld et al.
6,551,005 B2 * 4/2003 Da Silva Oliveira ... B62D 7/16 403/114
6,615,498 B1 9/2003 King et al.
6,760,941 B2 * 7/2004 Coleman, Jr. ..... B25B 11/002 403/76
6,810,744 B2 11/2004 Bueno-Bigue et al.
6,880,253 B1 4/2005 Gyllerstrom
6,892,457 B2 5/2005 Shiba et al.
7,037,022 B2 * 5/2006 Schonhoff ..... B60G 7/005 403/114
7,044,542 B2 * 5/2006 Muscat ..... B62J 1/007 403/90
7,124,755 B2 * 10/2006 Van Hooser ..... A61M 16/08 128/845
7,137,205 B2 11/2006 Royle
7,140,116 B2 11/2006 Coffin
7,341,017 B2 * 3/2008 Jackson ..... B63B 17/00 114/343
D566,897 S * 4/2008 Lee ..... D28/46
D568,000 S * 4/2008 Wonderley ..... D28/48
7,383,619 B2 * 6/2008 Gross ..... A46B 5/02 15/143.1
7,461,456 B2 12/2008 Tsushio et al.
7,475,483 B2 1/2009 Peyser et al.
7,757,404 B2 7/2010 Ouchi et al.
7,802,368 B2 9/2010 Coffin et al.
8,060,975 B2 * 11/2011 Williams ..... B05C 17/022 15/144.2
8,205,343 B2 6/2012 Winter et al.
8,205,344 B2 6/2012 Stevens
8,393,082 B2 3/2013 Shimizu
8,448,284 B2 * 5/2013 Gross ..... A46B 5/02 15/143.1
8,474,144 B2 7/2013 Royle
8,567,068 B2 10/2013 Luxton
8,663,240 B2 3/2014 Kling et al.
8,671,577 B2 3/2014 Brown
8,720,072 B2 * 5/2014 Bucco ..... B26B 21/522 30/527
8,745,882 B2 6/2014 Murgida et al.
8,745,883 B2 6/2014 Murgida et al.
8,888,390 B2 11/2014 Gueret
9,108,329 B2 * 8/2015 Stiles ..... B26B 21/22
9,527,219 B2 12/2016 Iwasaki et al.
9,533,422 B2 1/2017 Perez-Lopez et al.
9,849,599 B2 * 12/2017 Gers-Barlag ..... B26B 21/52
9,889,572 B2 * 2/2018 Bucco ..... B26B 21/521
10,406,704 B2 * 9/2019 Barrett ..... B26B 21/521
2003/0074798 A1 4/2003 Follo
2004/0025356 A1 * 2/2004 Gilder ..... B26B 21/225 30/527
2004/0035003 A1 2/2004 Stiles
2004/0055159 A1 3/2004 Khomari
2004/0177519 A1 9/2004 Tomassetti et al.
2004/0181953 A1 9/2004 Follo et al.
2007/0124936 A1 6/2007 Okabe
2008/0034591 A1 2/2008 Fung
2008/0086899 A1 * 4/2008 Gallagher ..... B26B 21/52 30/526
2009/0255124 A1 * 10/2009 Hasbani ..... B26B 21/225 30/50
2009/0313837 A1 12/2009 Winter et al.
2010/0005669 A1 * 1/2010 Winter ..... B26B 21/522 30/526
2010/0043242 A1 2/2010 Stevens
2610/0313426 12/2010 Royle
2011/0035950 A1 2/2011 Royle
2012/0005900 A1 1/2012 Erndt et al.
2014/0109735 A1 * 4/2014 Shepperson ..... B26B 21/521 30/527
2016/0121495 A1 * 5/2016 Johnson ..... B26B 21/4012 30/532
2016/0263757 A1 * 9/2016 Vandervelde ..... B26B 21/522
2019/0152077 A1 * 5/2019 Kim ..... B26B 21/4012
2019/0152078 A1 * 5/2019 Jang ..... B26B 21/521
2019/0152079 A1 * 5/2019 Chang ..... B26B 21/522
2019/0255721 A1 * 8/2019 Psimadas ..... B26B 21/521

FOREIGN PATENT DOCUMENTS

CN 101045303 A 10/2007
CN 201077087 Y 6/2008
CN 201089169 Y 7/2008
CN 101362341 A 2/2009
DE 202004014032 U1 1/2005
DE 202006011254 12/2006
EP 0885697 A1 12/1998
EP 1115537 B1 7/2006
EP 14002018 8/2014
FR 784362 A 7/1935
FR 788033 A 10/1935
FR 2639280 5/1990
FR 2639280 A1 * 5/1990 ..... B26B 21/06
GB 397346 A 8/1933
GB 426651 A 4/1935
GB 483608 A 4/1938
GB 2458316 A 9/2009
GB 2463035 A 3/2010
JP S6258572 U 4/1987
JP S62104770 U 7/1987
JP S6352578 U 4/1988
JP H0252694 A 2/1990
JP H0294782 U 7/1990
JP 2009045164 A 3/2009
WO 8910245 A1 11/1989
WO 2011094887 A1 8/2011
WO PCT/US2011/047330 1/2012
WO 2012021666 A1 2/2012

* cited by examiner

RAZOR WITH CUTTING BLADE ROTATABLE ABOUT MULTIPLE AXES

CROSS-REFERENCE TO RELATED APPLICATIONS

The present application is a continuation of U.S. application Ser. No. 14/266,913, filed May 1, 2014 and now patented as U.S. Pat. No. 9,889,572, which is a continuation of U.S. application Ser. No. 13/030,752, filed Feb. 18, 2011 and now patented as U.S. Pat. No. 8,720,072, which claims the benefit of U.S. Provisional Application Ser. No. 61/372,662, filed Aug. 11, 2010.

BACKGROUND

Field

The present invention relates to the field of consumer products and particularly to a razor with blade holder that is pivotable around three axes.

Description of Related Art

In a shaving tool for personal grooming, one well-known design is the safety razor that has a blade cartridge holding one or more blades at an appropriate angle for shaving, with the blade cartridge connected to a handle. As the face, etc. or other body portion being shaven is not flat, the user must articulate the handle around three axes while moving the blade over the skin to achieve a suitable result. This requires a certain level of dexterity on the part of the user.

In recognition of this, it is known to mount the blade cartridge to the handle in a manner to allow the blade cartridge to pivot around an axis parallel to the cutting edge(s) of the blades. However, this limited range of motion still requires the manual dexterity of the user to rotate the blade around other axes. Therefore, a better solution is lacking.

SUMMARY

A razor according to the instant disclosure includes a handle and detachable blade cartridge. The end of the handle has a pivot sphere upon which the blade cartridge is rotatably mounted, with freedom to pivot around three axes of the handle, and otherwise holds its orientation relative to the handle. The blade cartridge is held to the pivot sphere by a clevis having recesses defined in at least the inner side surfaces of its legs. The recesses, together with the clevis, are sized to admit the pivot sphere between them and to hold the sphere therein once admitted. The clevis and/or the pivot sphere can be formed of a resilient injection molded plastic. The range of motion of the blade cartridge may be limited by forming one or more stops on the pivot sphere to interact with the clevis and thereby interrupt its free rotation.

In a particular embodiment, a personal grooming apparatus comprises a handle having a gripping portion and an attachment portion operative to rotably support a cartridge for rotational movement around at least two axes. The cartridge includes a clevis with first and second opposed legs, spaced from one another, each of the first and second legs having a respective recess in a side facing the opposing leg, the respective recesses sized, shaped and positioned such that the attachment portion is received simultaneously in both recesses, with the cartridge being pivotably mounted upon the attachment portion with freedom of motion around at least two axes.

In a further embodiment, the cartridge comprises a central recess between the first and second legs receiving and substantially covering an end of the attachment portion. The attachment portion may comprise a sphere or part thereof having a first radius. The sphere or part thereof may comprise a plurality of elements approximating the surface of the sphere. At least one of the plurality of elements approximating the surface of the sphere may be resilient to facilitate attachment between the sphere or part thereof with the cartridge.

In a further embodiment, the central recess may comprise either a spherical section or a toroidal section, the spherical section or toroidal section being defined by a radius substantially equal to, or greater than, the first radius of the sphere or part thereof.

The recesses in each of the first and second legs may be either cylindrical or spherical recesses. At least one of the recesses in each of the first and second legs may be a through opening that perforates the side of its respective first or second leg facing away from the opposing leg.

In a further embodiment, at least one of the first and second legs comprises a relief portion inclined toward the opposing one of said first and second legs, said relief portion being operative to facilitate the insertion of the attachment portion between the first and second legs. The relief portion may comprise a spherical section surface, optionally having a radius substantially equal to or greater than that of the sphere of the attachment portion, where the attachment portion is provided with a sphere or part thereof.

In a particular embodiment, at least one of the first and second legs comprise a resilient material, said leg being operative to deflect under the pressure of the attachment portion upon insertion of the attachment portion between the first and second legs, and thereby admit the attachment portion between the first and second legs.

In a further embodiment, the attachment portion further comprises at least one stop extending above its surface to partially obstruct the rotation of the cartridge when the cartridge is mounted upon the attachment portion. In a further embodiment, two symmetric and diametrically opposed stops are provided.

The cartridge may be mounted on the attachment portion operative to hold the orientation of the cartridge with respect to the handle at rest, yet pivot freely under an applied pressure.

The attachment portion may comprise an attachment arm by which it is mounted to the handle. The attachment arm may extend at an angle to the axis of the handle. The attachment arm may further be configured to reduce in diameter, for example as a frusto-conical shape, and may further be attached to the handle by the relatively larger-diameter portion of the attachment arm.

These and other features, advantages and benefits of the present disclosure will become apparent from the following description.

DETAILED DESCRIPTION OF THE FIGURES

DETAILED DESCRIPTION OF THE EMBODIMENTS

Figure 1:
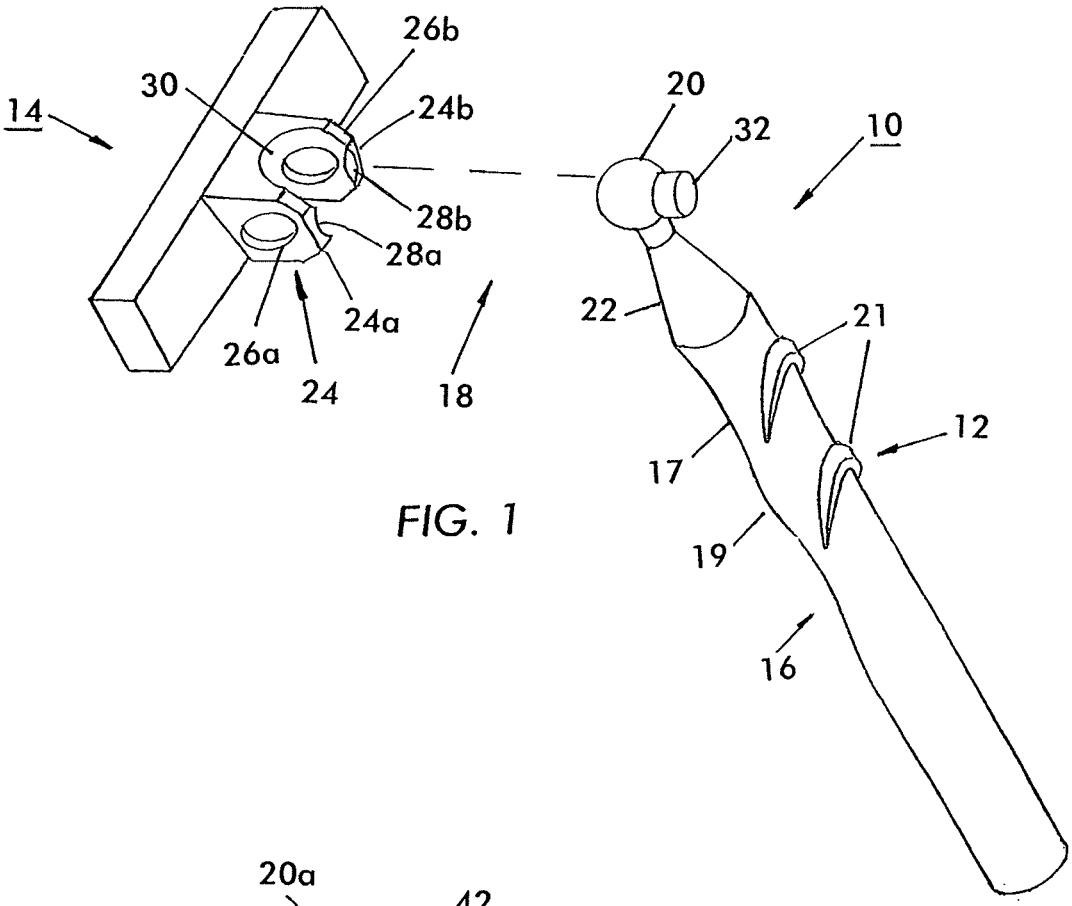
FIG. 1 illustrates a razor according to an exemplary embodiment of the present disclosure, in an exploded assembly view wherein a blade cartridge thereof is separated from the handle along the phantom line.

Referring now to FIG. 1, illustrated is an exploded assembly view of a three axis safety razor, generally 10, according to an exemplary embodiment of the present disclosure. The razor 10 includes a handle 12, and a blade cartridge 14 pivotally connected to the handle 12. The handle 12 includes a gripping portion 16. The gripping portion 16 is illustrated as generally cylindrical, however, it is contemplated, and, in fact, preferred that the gripping portion 16 have some features to enhance its friction when held in the hand of the user.

Among these features, without limitation, the shape of the gripping portion 16 may be varied from the generally right circular cylinder as illustrated, for example, to other prismatic shapes such as triangular, rectangular (including square) or hexagonal prisms, among others, and/or to optionally include some combination of lands and curves. The gripping portion 16 may be further provided with one or more localized depressions 17 and/or protuberances 19 to receive the fingers of a user's hand. The surface of the gripping portion 16 may be provided with texture and/or friction enhancements, including without limitation knurling, localized or general surface roughening, and friction-enhancing appliqués 21, including those which may raise the height of the surface to which they are applied.

At a first end 18 of the handle 12, a pivot sphere 20 is secured to and/or made part of the handle 12. Designating the structure as a pivot sphere does not preclude the possibility that the pivot sphere may be only partially spherical, as described further below. In a further embodiment, shown for example in FIG. 2, the pivot sphere may be formed by a plurality of elements 40 approximating a sphere (or part thereof). Optionally, those elements 40 may themselves be resilient to deform from a spherical surface to permit the pivot sphere 20*a* to be connected with the blade cartridge 14. Moreover, in the embodiment illustrated in FIG. 2, the gaps 42 between elements 40 are substantially parallel with one another and circumferential with the sphere 20*a*. This need not be the case, however. As well, the gaps may be formed around poles of the sphere that are not substantially aligned with the stops 32*a*, 32*b*, as illustrated. For example, the gaps 42 may be formed to meet at or near the attachment with arm 22. Other variations will be apparent to those of skill in the art, in light of the instant disclosure.

Returning to the exemplary embodiment, pivot sphere 20 is mounted to the handle 12 at the end of an arm 22. Arm 22 preferably achieves a reduction in diameter from the gripping portion 16 of the handle 12, to reduce and/or avoid obstructing the pivoting of the blade cartridge 14 about the pivot sphere 20. In the exemplary embodiment, arm 22 is frusto-conical in shape, with a smaller diameter end adjacent to and connected with the pivot sphere. Moreover, the arm 22 may be offset such that its longitudinal axis diverges from a longitudinal axis of the handle 12 generally, or gripping portion 16 specifically, in order to further distance the blade cartridge 14 from the handle 12. In alternate embodiments, the arm 22 supporting the pivot sphere 20 may be mounted along the length of the handle 12, rather than at or near an end. One manner of mounting the arm 22 may be substantially perpendicular to the axis of the handle 12, approximating a "T"-shape between the handle 12 and the arm 22. Other configurations, e.g., "C", "J", "L", "Y"-shaped combinations of handle 12 and arm 22, are clearly conceivable within the scope of the instant disclosure.

Blade cartridge 14 includes a clevis 24 for pivotably securing the blade cartridge 14 to the pivot sphere 20. The clevis 24 includes two opposed legs 24*a*, 24*b*. Each leg 24*a*, 24*b* has a hole 26*a*, 26*b*, respectively. In the exemplary embodiment, holes 26*a*, 26*b* are through holes which traverse their respective legs 24*a*, 24*b*, however, they need not perforate the legs 24*a*, 24*b* entirely. Holes 26*a*, 26*b* are sized and spaced such that the clevis 24 can be installed over the pivot sphere 20, and be retained there in connection with the handle 12. The tolerances of fit between the clevis 24, specifically holes 26*a*, 26*b*, and pivot sphere 20, are readily adjustable by those having skill in the art without departing from the scope of the present disclosure. In a preferred embodiment, the tolerances are set to achieve a fit between clevis 24 and sphere 20 such that the cartridge 14 holds its orientation with respect to the handle 12 at rest, yet pivots freely under any applied pressure.

In the exemplary embodiment, the clevis 24 is optionally provided with a recess 30, between legs 24*a*, 24*b* and below holes 26*a*, 26*b*. The recess may be configured as a spherical section, or alternately may resemble a portion of a torus. The radius of the recess 30 when configured as a spherical section, or the outer radius of the torus section where configured as such, is preferably no smaller than the diameter of the pivot sphere 20. The recess should not interfere with the pivoting of the blade cartridge on the pivot sphere. A close fit between the pivot sphere 20 and the recess 30 may enhance the ability of the cartridge 14 to hold its position, and can also inhibit the ingress of water or shaving detritus (e.g., foam, cut hair, etc.) that might inhibit the ability of the cartridge to change position under pressure.

The nature of the fit between the clevis 24 and the pivot sphere 20 is that the maximum diameter of the pivot sphere 20 is greater than the distance between the legs 24*a*, 24*b*, and their included holes 26*a*, 26*b*, or more specifically, the nearest facing surfaces of legs 24*a*, 24*b* and/or holes 26*a*, 26*b*. To accommodate the assembly of the cartridge 14 with the handle 12, either the pivot sphere 20, or one or both of legs 24*a*, 24*b*, or any of them, may be constructed of a resilient material which yields to the degree necessary to mate the cartridge 14 to the handle 12, yet return to their previous respective states once assembled.

The clevis 24 may be provided with one or more relief portions 28*a*, 28*b* as illustrated. Relief portions in this exemplary embodiment are generally spherical sections, and preferably have a radius at least as great as that of the pivot sphere 20. Relief portions 28*a*, 28*b* guide and ease the interface between the pivot sphere 20 and the clevis 24 on their assembly. In connection with this, making the interface between the pivot sphere 20 and the clevis 24 easy and reliable makes it possible to allow the user to exchange and replace the blade cartridge 14 at that interface in the ordinary course of use. This eliminates the need for an additional point of separation to achieve a blade change, thereby simplifying the construction of the blade cartridge 14. However, this does not exclude an additional point of separation, pivoting and/or articulation in connection with blade cartridge 14 described in the present disclosure.

The clevis 24 described herein is advantageously formed of an injection molded plastic and/or metal, for economic benefits in cost of material and manufacture. Alternately, the clevis 24 can be formed and injection molded integrally with the frame of the blade cartridge 14, which is completed by the addition of the blades themselves, among other accessories as desired.

As described above, a razor 10 has a blade cartridge 14 that can freely move around three axes of the handle 12. However, while such freedom of motion is desirable, it may be further desired to limit the range of motion of the blade cartridge 14, for example to avoid extreme or unusual orientations of the blade cartridge 14. This can be accomplished by altering the shape of the pivot sphere 20, for example to provide a stop 32. The stop 32 is sized and positioned to obstruct the clevis 24, and thereby limit its range of motion about the pivot sphere 20. In the exemplary embodiment disclosed, the stop 32 is formed integrally with the remainder of the pivot sphere 20, as a molded part thereof. Alternately, the stop 32 may be a separate structure, secured either permanently or removably to the pivot sphere 20, for example, without limitation, by adhesive or fastener. One or more such stops 32 may be provided, which individually or in combination can permit nearly any desired range of motion in the blade cartridge 14 about the handle 12.

The stop 32 is illustrated in FIG. 1 as a simple circular cylindrical projection. However, the size, shape and height of the stop 32, or several of them, may be selected as desired in consideration of the shape of the clevis 24 and specifically its legs 24*a*, 24*b*. The stop 32 may be shaped to obstruct movement in certain orientations, but not in others. As an example only, once connected in the orientation illustrated in FIG. 1, the stop 32 largely inhibits the lateral rotation of the blade cartridge 14. On the other hand, the blade cartridge 14 is free to rotate about its transverse axis, to 'lift its head' in a manner of speaking. Having done so, the blade cartridge now has additional freedom of lateral rotation, not possible in the prior orientation because of the interaction of the legs 24*a*, 24*b* with the stop 32. This discussion is offered merely as an example of the possible range of motion that could be obtained by the configuration of the stop 32, and further alteration will be apparent to those of ordinary skill in the art in light of the instant disclosure.

Figure 2:
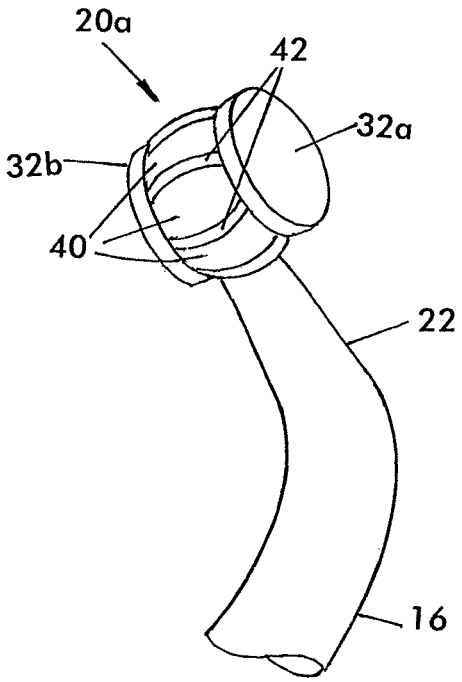
FIG. 2 illustrates an alternate embodiment of a razor according to the present disclosure, as a detail view of the end of handle.

In one embodiment, illustrated in FIG. 2, two such stops 32*a*, 32*b* are substantially diametrically opposed to one another on the pivot sphere 20*a*. Stops 32*a*, 32*b* are, in this embodiment formed by deforming a spherical section into a plane, with the excess material rising above the surface of the sphere 20*a* to restrict the movement of the blade cartridge 14. The embodiment of FIG. 2 includes the planes formed by this method of creating stops 32*a*, 32*b* being angled with respect to one another. The planes are closer together at the attachment of the sphere 20*a* with the arm 22. They may, in other embodiments, be angled differently, or parallel with each other.

The foregoing disclosure has been made with reference to certain exemplary and/or preferred features and embodiments. These are not limiting upon the scope of the disclosure. Certain modification, alterations, or substitutions will be apparent to those of ordinary skill in the art in light of the present disclosure.

What is claimed is:

1. A personal grooming apparatus, comprising:

a handle having a gripping portion and an attachment portion, the attachment portion including a pivot member having an at least partially spheroid portion; and a cartridge supporting at least one cutting blade;

wherein rotation of the cartridge is enabled by retention of the pivot member between spaced-apart ends of two opposed legs, the pivot member of the attachment portion pivotably held between the spaced-apart ends of the two opposed legs; and a stop extending outward from the at least partially spheroid portion of the pivot member and configured to limit rotation of the cartridge when the cartridge is mounted on the attachment portion;

wherein the stop is configured to limit rotation of the cartridge by interacting with a relief portion of at least one of the two opposed legs.

2. The personal grooming apparatus of claim 1, wherein the gripping portion supports the at least partial spheroid portion of the pivot member.

3. The personal grooming apparatus of claim 1, wherein the two opposed legs form a portion of the cartridge.

4. The personal grooming apparatus of claim 1, wherein the gripping portion includes friction enhancing depressions and protuberances.

5. The personal grooming apparatus of claim 1, wherein the stop is formed integrally with the pivot member as a molded part thereof.

6. The personal grooming apparatus of claim 1, wherein the relief portion is configured to facilitate insertion of the pivot member between the spaced-apart ends of the two opposed legs.

7. The personal grooming apparatus of claim 1, wherein the two opposed legs have respective holes formed therein, and wherein the spheroid portion of the pivot member is pivotably held between the holes formed in the two opposed legs.

8. The personal grooming apparatus of claim 7, wherein the relief portion is disposed on an interior surface of at least one of the two opposed legs.

9. The personal grooming apparatus of claim 8, wherein the relief portion comprises a C-shaped cutout of the interior surface of at least one of the two opposed legs.

10. A razor handle, comprising:

an elongate body having a gripping portion;

a pivot member at one end of the body, the pivot member capable of removably attaching a cartridge supporting at least one cutting blade;

wherein the pivot member includes an at least partially spheroid portion configured to be held between spaced-apart ends of two opposed legs; and a stop protruding from a surface of the at least partially spheroid portion of the pivot member and configured to limit rotation of the pivot member;

wherein the stop is configured to limit rotation of the pivot member by interacting with a relief portion of at least one of the two opposed legs.

11. The razor handle apparatus of claim 10, wherein the gripping portion supports a spheroid including the pivot member.

12. The razor handle of claim 10, wherein the gripping portion includes friction enhancing depressions and protuberances.

13. The razor handle of claim 10, wherein the gripping portion includes a friction enhancing attachment to the elongate body.

14. The razor handle of claim 10, wherein the stop is formed integrally with the pivot member as a molded part thereof.

15. The razor handle of claim 10, wherein the relief portion is configured to facilitate insertion of the pivot member between the spaced-apart ends of the two opposed legs.

16. A razor, comprising:

a cartridge supporting at least one cutting blade;

a handle having an elongate gripping portion and an attachment portion at one end of the handle, the attachment portion supporting a pivot member providing a removable attachment to the cartridge;

wherein the pivot member includes an at least partially spheroid portion that is configured to be held between spaced-apart ends of two opposed legs; and a stop protruding from a surface of the at least partially spheroid portion of the pivot member and configured to limit rotation of the cartridge when the cartridge is mounted on the attachment portion;

wherein the stop is configured to limit rotation of the cartridge by interacting with a relief portion of at least one of the two opposed legs.

17. The razor of claim 16, wherein the two opposed legs extend from the cartridge.

18. The razor of claim 16, wherein the gripping portion includes friction enhancing depressions and protuberances.

19. The razor of claim 16, wherein the stop is formed integrally with the pivot member as a molded part thereof.

20. The razor of claim 16, wherein the relief portion is configured to facilitate insertion of the pivot member between the spaced-apart ends of the two opposed legs.

* * * * *